United States Patent [19]

Eck et al.

[11] Patent Number: 4,832,619

[45] Date of Patent: May 23, 1989

[54] PIN MOUNTED SUPPORT SYSTEM FOR PRINTED CIRCUIT CARDS AND CONNECTORS

[75] Inventors: Michael P. Eck, Wellsville, Pa.; Dale E. Lecrone, Plano, Tex.

[73] Assignee: E. I. Du Pont de Nemours and Company, Wilmington, Del.

[21] Appl. No.: 228,511

[22] Filed: Aug. 5, 1988

[51] Int. Cl.[4] ..... H01R 13/629

[52] U.S. Cl. ..... 439/377; 211/41; 439/681

[58] Field of Search ..... 439/64, 377, 633, 681; 361/413, 415; 211/41

[56] References Cited

U.S. PATENT DOCUMENTS

| | | | |
|---|---|---|---|
| 3,149,894 | 9/1964 | Fox | 339/17 |
| 3,166,372 | 1/1965 | Just | 339/186 |
| 3,253,246 | 5/1966 | Mc Connell et al. | 339/17 |
| 3,518,620 | 6/1970 | Busney et al. | 339/184 |
| 3,533,045 | 10/1970 | Henschen | 339/17 |
| 3,704,394 | 11/1972 | Johnson | 439/64 |
| 3,895,719 | 7/1975 | Cakora | 211/41 |
| 3,930,706 | 1/1976 | Obuch et al. | 339/64 |
| 3,942,854 | 3/1976 | Klein et al. | 339/17 |
| 3,960,423 | 6/1976 | Weisenburger | 339/17 |
| 3,982,159 | 9/1976 | Dennis et al. | 317/101 |
| 3,993,384 | 11/1976 | Dennis et al. | 339/17 |
| 4,046,443 | 9/1977 | Champagne | 339/66 |
| 4,050,755 | 9/1977 | Hasirgoglu | 339/17 |
| 4,068,290 | 1/1978 | Wetherbee | 361/415 |
| 4,109,300 | 8/1978 | Reimer | 361/415 |
| 4,241,381 | 12/1980 | Cobaugn et al. | 361/413 |
| 4,376,562 | 3/1983 | Kaley | 339/75 |
| 4,536,047 | 8/1985 | Varone et al. | 339/75 |
| 4,568,134 | 2/1986 | Di Mondi | 339/17 |
| 4,585,284 | 4/1986 | Koser et al. | 339/17 |
| 4,597,626 | 7/1986 | Gaboard et al. | 339/184 |

FOREIGN PATENT DOCUMENTS

| | | | |
|---|---|---|---|
| 230972 | 6/1962 | German Democratic Rep. | 361/415 |

*Primary Examiner*—Gary F. Paumen

[57] ABSTRACT

A pin mounted support system for printed circuit cards and connectors includes a base portion having one or more bores for mounting upon the pins of the header and a guide surface portion that delimits the installed position of the printed circuit card or connector. Where the support is intended for use with a printed circuit board, the support includes a groove or track for accepting and supporting a lateral edge of the printed circuit board. Where the support is intended for use with a connector terminated cable, a keytab is provided with one or more bores for mating with the pins of the header to delimit the proper position of the connector. The connector is positioned between the keytabs and installed in its mated position. The supports are typically fabricated from a molded plastic and are easily removable from their support pins to allow convenient reconfiguring of the header.

13 Claims, 4 Drawing Sheets

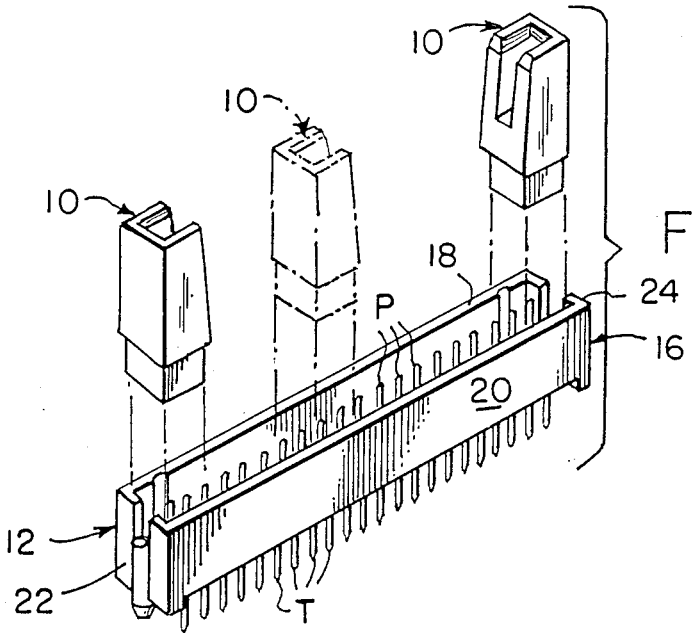
FIG. 1
FIG. 2
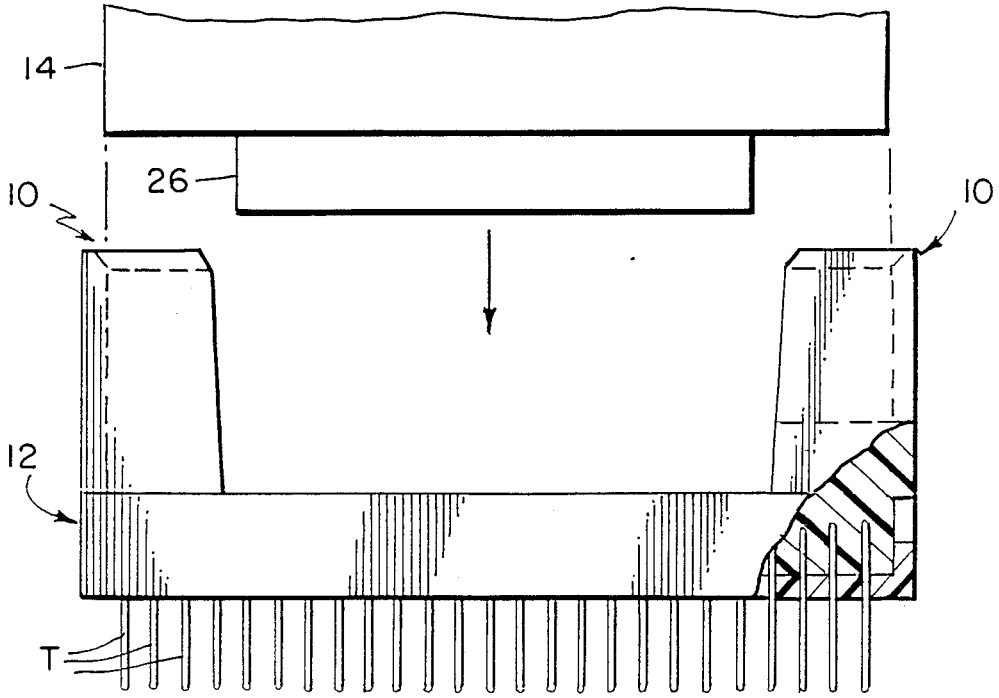

PIN MOUNTED SUPPORT SYSTEM FOR PRINTED CIRCUIT CARDS AND CONNECTORS

BACKGROUND OF THE INVENTION

The present invention relates to devices for mechanically mounting and mating printed circuit boards and header terminated cables to their connectors.

Electronic systems oftentimes use a number of printed circuit boards that are plugged into a motherboard in spaced parallel positions. Typically, the motherboard is provided with a series of spaced headers and each printed circuit board is provided with a connector on one edge for insertion into its header. In most systems, guides are provided to assist in aligning and guiding the printed circuit board into its header to prevent a mis-mated condition. In card-cage type systems, the guides are designed as part of the enclosure and represent an increment of cost and design complexity. While motherboards can be designed without guideways, the probability of a mis-mated condition increases, particularly in those bus systems that use printed circuit cards having different length edge connectors, i.e., systems that use full-length and half-length printed circuit cards. It is also known to plug connector terminated cables, typically ribbon cables, into the header to effect connection between various circuits. Oftentimes, the connector has a length less than that of its connector and guides or keys must be provided to assure that the connector is mated with the proper portion of the pin field. While various type of guides are known, the oftentime add to the design complexity and cost of the overall system.

SUMMARY OF THE INVENTION

In view of the above, it is an object of the present invention, among others, to provide a pin mounted support system for printed circuit cards and connectors that assists in aligning and guiding the printed circuit board or connector into its mated position and yet is inexpensive to produce and install.

It is another object of the present invention to provide a pin mounted support for a printed circuit board which is mounted on selected pins of a header and which includes a guideway that aligns and retains the printed circuit board in its installed position.

It is another object of the present invention to provide a pin mounted support for a connector which is mounted on selected pins of a header and which delimits the desired installation position of the connector.

It is still another object of the present invention to provide pin mounted supports that inexpensively provide a measure of design flexibility in configuring headers to accept printed circuit boards and/or connectors.

In view of these objects, and others, the present invention provides a pin mounted support system for printed circuit cards and connectors in which the support is mated with selected pins of a header and functions to assist in delimiting the desired installed position of the printed circuit board or connector and assists in guiding the device into its mated position. In an embodiment for use with printed circuit boards, the support includes a base portion having one or more bores for mounting upon the pins of the header and a guide portion that includes a groove or track for accepting and supporting a lateral edge of the printed circuit board. The lateral edges of the printed circuit board are aligned with the respective groove in the support and guided into the installed position with the support maintaining the printed circuit board in position. In another embodiment for use with connector terminated cables, a keytab is provided with one or more bores for mating with the pins of the header to delimit the proper position of the connector. The connector is aligned between the keytabs and installed in its mated position. The supports are typically fabricated from a molded plastic and are easily removable from their support pins to allow reconfiguring of the install-positions of the header.

The present invention advantageously provides a pin mounted support system for printed circuit cards and connectors to enable the convenient and reliable mating of printed circuit cards and headers with their connectors.

Other objects and further scope of applicability of the present invention will become apparent from the detailed description to follow, taken in conjunction with the accompanying drawings, in which like parts are designated by like reference characters.

BRIEF DESCRIPTION OF THE DRAWING

FIG. 1 is a perspective view of an exemplary header and two card-supports for installation in the header;

FIG. 2 is a front elevational view of the header and card supports of FIG. 1 with a printed circuit board positioned for insertion into its supports and the header;

DESCRIPTION OF THE PREFERRED EMBODIMENT

Figure 7:
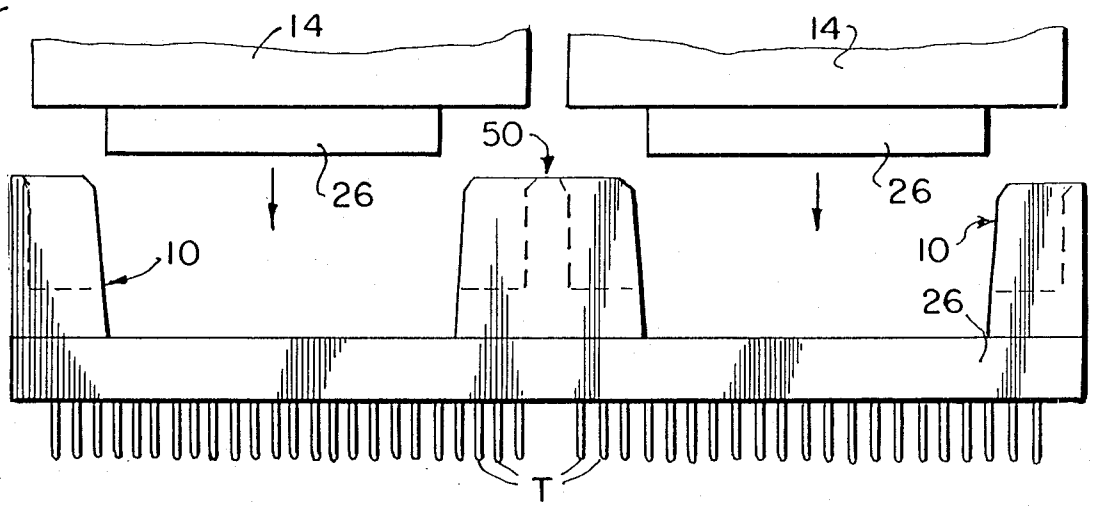
FIG. 7 is a front view of the card supports of FIG. 1 and the dual card-support of FIG. 6 and two printed circuit cards to be mounted in a side-by-side relationship.

Pin mounted supports in accordance with the present invention are shown in FIGS. 1 and 2 and are designated generally therein by the reference character 10. As shown, the supports 10 are designed to cooperate with a header, indicated generally at 12, for aligning, guiding, and supporting a printed circuit board 14. The header 12 is of conventional design and includes a housing 16 defined by spaced sidewalls 18 and 20 and endwalls 22 and 24 that define a recess (unnumbered) for accepting a mating connector (now shown in FIG. 1). An array or field of contacts, such as the pins P illustrated, are mounted in the housing 16 with a selected inter-pin spacing. Each pin P includes a respective tail portion T that extends rearwardly of the housing 16. Suitable headers include those of the RIB CAGE connector system and the HPC-XXXX series connector system and their variations marketed by DuPont Electronics of New Cumberland, Pa. 17070. As explained in more detail below, each pin mounted support 10 is designed to be mounted upon selected of the pins P, such as the extreme end positions shown in FIG. 1 or, if preferred, some intermediate position as represented in dotted-line illustration in FIG. 1. Once the pin mounted supports 10 are mounted to the header 12, a printed circuit board 14, which includes a connector 26, can be mated to its header 12 by aligning the printed circuit board 14 with the header 12 and the pin mounted supports 10 and guiding the printed circuit board 14 and its connector 26 into its desired mated position. The pin mounted support 10 serves a number of functions including the initial pre-insertion alignment of the printed circuit board 14 relative to its header 12, the guiding of the aligned printed circuit board 14 into its mated position, and, lastly, physical support of the installed printed circuit board 14.

Figure 5:
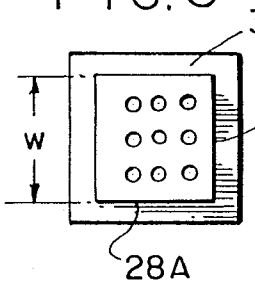
FIG. 5 is a bottom view of the card support of FIG. 4.
Figure 4:
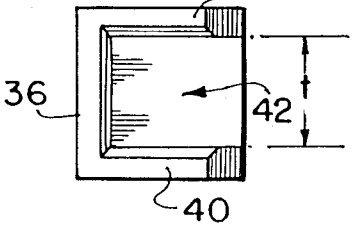
FIG. 4 is a top view of a card support shown in FIGS. 1 and 2.
Figure 3:
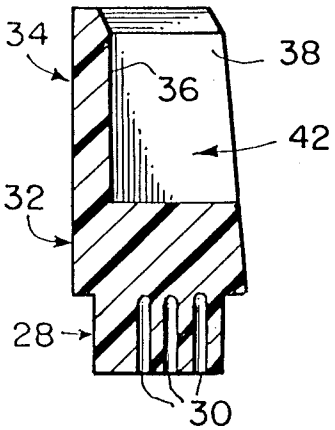
FIG. 3 is an elevational view, in cross-section, of a card support shown in FIGS. 1 and 2.

As shown in the detailed views of FIGS. 3, 4, and 5, each pin mounted support 10 includes a base 28 defined by sides 28A and 28B and having a lateral width dimension w that is less than that corresponding dimension between the facing surfaces of the sidewalls 18 and 20. The base 28 is dimensioned so that the side 28A is positioned intermediate two adjacent columns of pins P, although it is contemplated that the side 28A can extend to an adjacent column of pins P and be provided with open grooves which receive the pins P. A plurality of pin-receiving bores 30 are provided in the base 28 and are arranged on a center-to-center spacing and pattern that corresponds to that of the pins P of the header 12. In the case of a header 12 having three rows of pins P arranged in a rectangular matrix with a fixed inter-pin spacing, the base 28 is provided with three rows of bores 30 on the same rectangular matrix pattern and inter-pin spacing. As can be appreciated, the base 28 is designed to fit over and be mounted upon a group of pins P at a selected location in the available pin field. In general, the pin mounted support 10 is dimensioned so that a line-to-line or slight interference fit exists between the parts so that the support 10 will be retained in place. If desired, the support 10 can be secured in place with a suitable adhesive. The pin mounted support 10 includes an intermediate section 32 that is enlarged somewhat relative the base 28 to define a shoulder 34 at the transition between the base 28 and the intermediate section 32. A guide structure, indicated generally at 34, is provided above the intermediate section 32 and includes a lateral wall 36 and spaced sidewalls 38 and 40 to define an alignment track or groove, indicated generally at 42, that is in substantial alignment with the longitudinal axes of the bores 30 and, accordingly, the pins P. The groove 42 is designed to accept the edge portion of the printed circuit board 14, and as shown in FIG. 4, the sidewalls 38 and 40 are spaced by a dimension t sufficient to accept the printed circuit board 14 with a line-to-line or slight clearance fit.

As shown in FIGS. 1 and 2, the pin mounted supports 10 are inserted into selected positions in the header 12 and the printed circuit board 14 is installed by aligning the edges of the printed circuit board 14 with the corresponding grooves 42 of the supports 10. The printed circuit board 14 is pushed into engagement with its header 12 so that the lateral edges of the printed circuit board 14 are restrained by the supports 10 to thus align and guide the connector 26 into its mated position with the bottom edge of the printed circuit board 14 contacting and resting upon the upper surface of the intermediate section 32. Once the printed circuit board 14 and the header 12 are connected, the pin mounted support 10 serves to provide a measure of lateral support that prevents misalignment of the printed circuit board 14 and its header 12. While the pin mounted supports 10 of FIGS. 1 and 2 have been shown at the extreme end positions of the header 12, the pin mounted supports 10 of the present invention are particularly useful in those situations where the length of the header 12 is larger than that of the connector 26 to thus delimit that portion of the pin field to which the printed circuit board 14 is to be connected.

Figure 6:
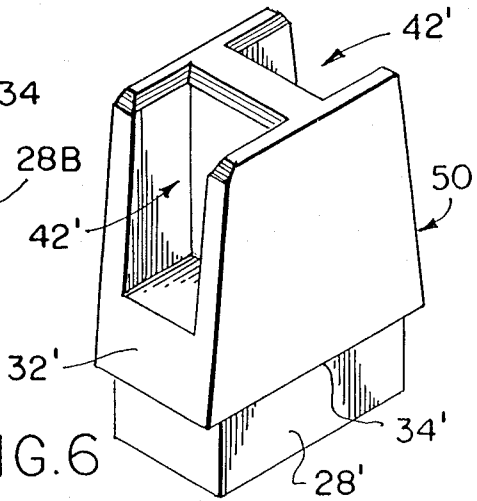
FIG. 6 is a perspective view of a dual card-support.

A dual pin mounted support variation of the supports 10 of FIGS. 1–5 is shown in FIG. 6 and designated generally therein by the reference character 50. The dual pin mounted support 50, as shown in FIG. 7, is designed to be mounted at an intermediate position in the header 12 and concurrently mount two printed circuit boards 14 in a side-by-side relationship. The dual pin mounted support 50 is fabricated in a manner analogous to that of the pin mounted support 10 and includes a base 28', an intermediate section 32' that defines a shoulder 34' with the base 28', and the necessary wall surfaces to provide back-to-back grooves 42' for accepting the lateral edges of the adjacent printed circuit boards 14. As shown in the figures, the top ends of the walls 36, 38, and 40 are provided with beveled lead-in surfaces (unnumbered) to assist in the initial engagement of the lateral edges of the printed circuit board 14 and the supports 10.

Figure 8:
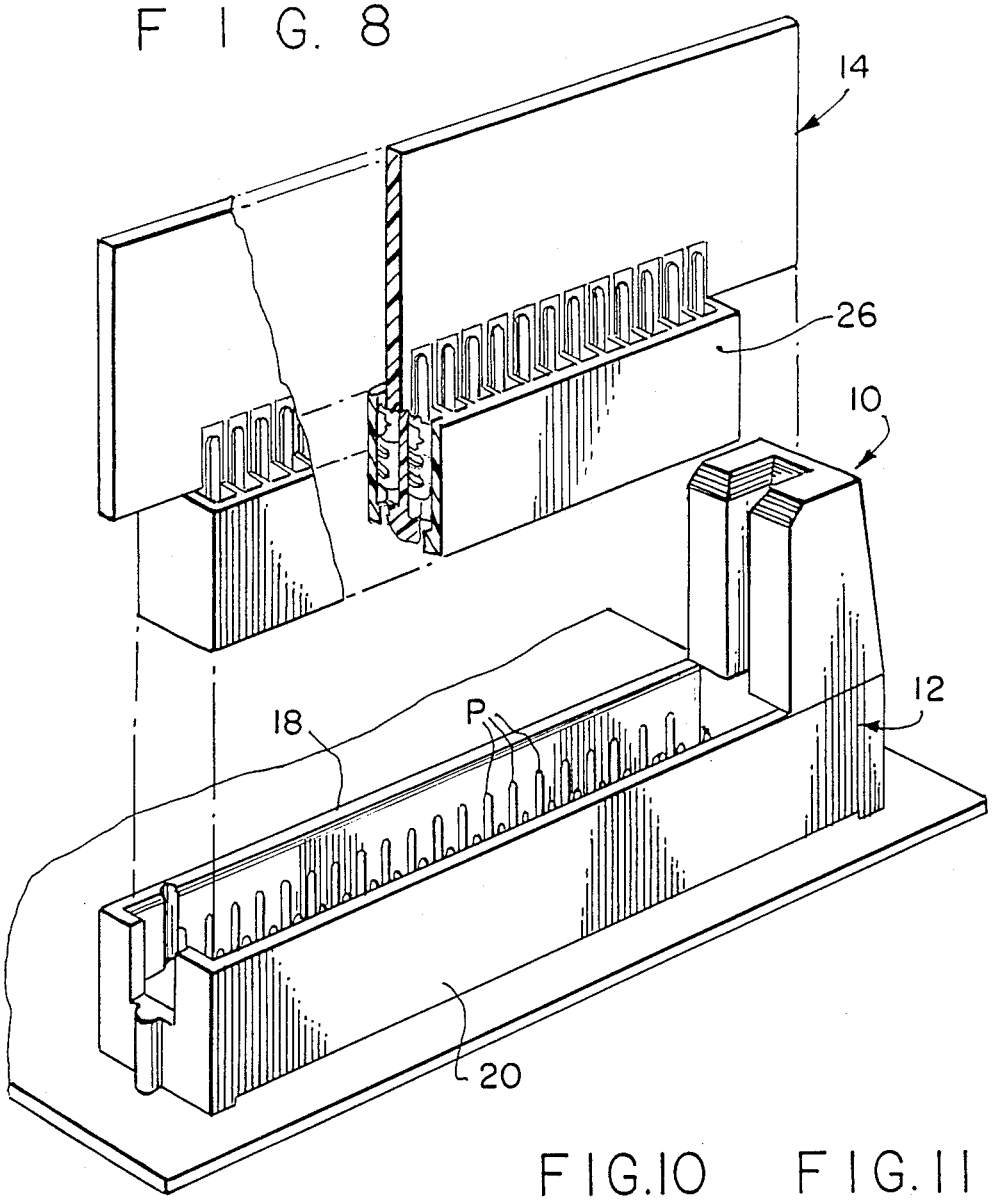
FIG. 8 is a perspective view of a printed circuit board installation using only one card-support.

In the embodiments above, the various printed circuit boards 14 have been shown with a pin mounted support 10 associated with each lateral edge. As shown in FIG. 8, a single pin mounted support 10 can be used to effect mounting a printed circuit board 14 and its associated header 26.

The pin mounted support 10 and the dual pin mounted support 50 are preferably molded as a unitary structure from a thermoplastic and can be color-coded with their header 12.

Figure 10:
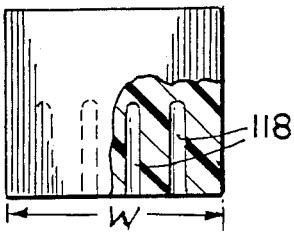
FIG. 10 is a front elevational view, in partial cross-section, of a keytab of FIG. 9.
Figure 11:
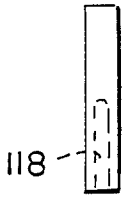
FIG. 11 is a side elevational view of the keytab of FIGS. 9 and 10.
Figure 9:
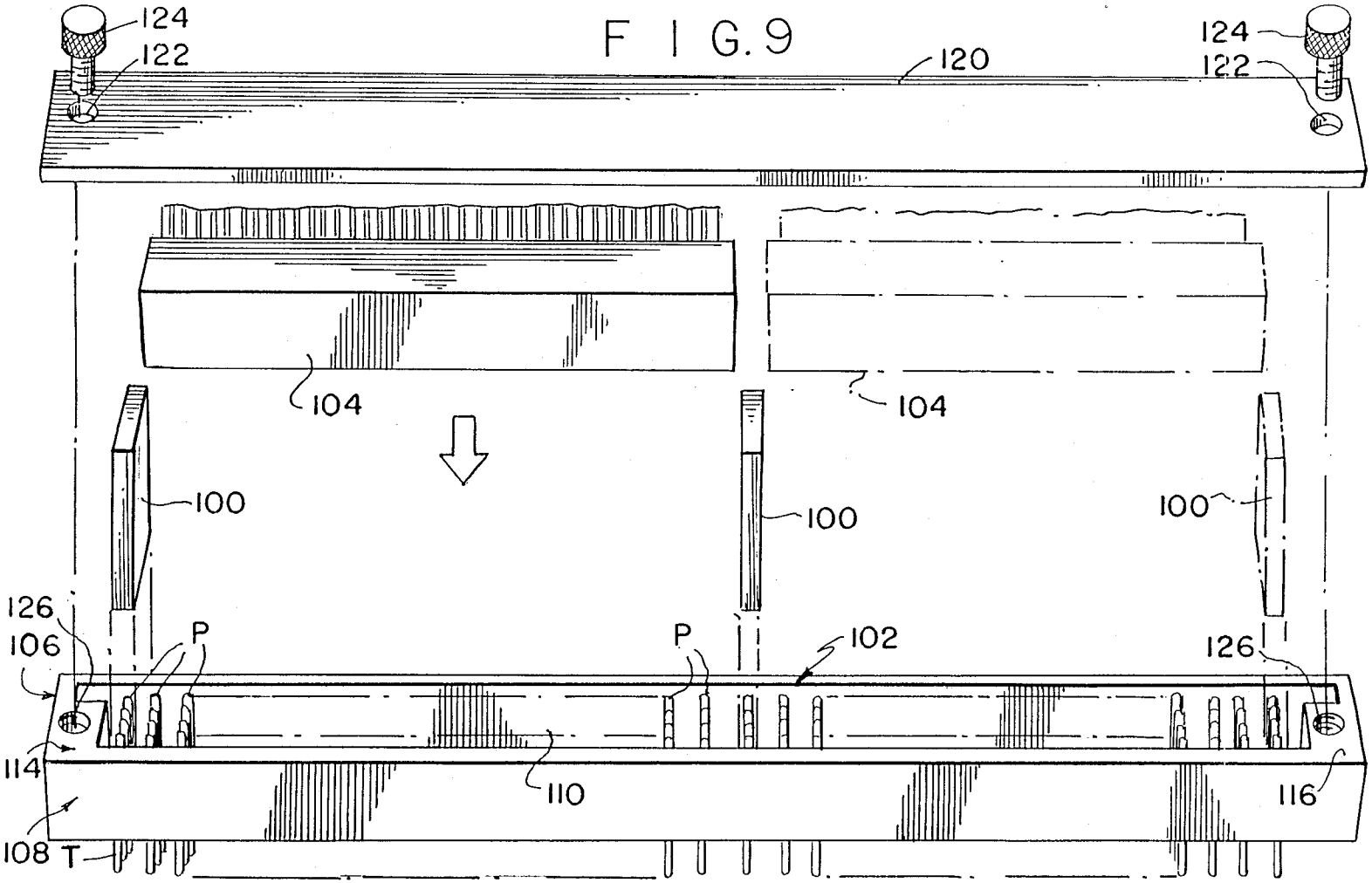
FIG. 9 is an exploded perspective view of a connector installation in which keytabs delimit the desired mated position of the connector.

Another embodiment of pin mounted supports, termed keytabs, in accordance with the present invention and especially suitable for mating connector terminated cables with their headers is shown in FIGS. 9, 10 and 11 and are designated generally therein by the reference character 100. As shown, the keytabs 100 are designed to cooperate with a header, indicated generally at 102, for delimiting and aligning a connector 104 with the header 102. The header 102 is of conventional design and includes a housing 108 defined by spaced sidewalls 110 and 112 and endwalls 114 and 116 that define a recess (unnumbered) for accepting the mating connector 104. An array or field of pins P is mounted in the housing 108 and includes respective tail portions T that extend rearwardly of the housing 108. The illustrated header 106 is representative of the HPC-XXXX series connector system marketed by DuPont Electronics of New Cumberland, PA 17070. As explained in more detail below, each keytab 100 is designed to be mounted upon selected of the pins P, such as the extreme left and the intermediate positions shown in solid line illustration in FIG. 9. Once the keytabs 100 are mounted to their pins P on the header 102, they function to delimit the desired position for the connector 104. Accordingly, the connector 104 can be aligned between the spaced keytabs 100 and pushed into its mated position with the header 102.

As shown in the detailed views of FIGS. 10 and 11, each keytab 100 is defined as a slab-like parallelepiped having a lateral width dimension w that is less than that corresponding dimension between the facing surfaces of the sidewalls 110 and 112. A plurality of pin-receiving bores 118 are provided in the keytab 100 and are arranged on a center-to-center spacing and pattern that corresponds to that of the pins P of the header 102. In the case of a header 102 having four rows of pins P, as shown in FIG. 9, the keytab 100 is provided with a row of four bores 118 on the same center-to-center spacing.

As shown in FIG. 9, a retaining bar 120 cooperates with the keytabs 100 to effectively capture the connector 104 and its cable in its mated position. The retaining bar 120 is fabricated from a metal or plastic strip and includes clearance bores 122 on its opposite ends and is secured in place against the rear surface of the connector 104 by threaded fasteners 124 engaging threaded bores 126 formed on the opposite ends of the header 106. While the keytabs 100 have been shown associated with a single column of four pins P, the keytabs 100 can be wider to accommodate two or more columns of pins P.

The present invention advantageously provides a pin mounted support system for printed circuit cards and connectors to enable the convenient and reliable mating of printed circuit cards and headers with their connectors. The present invention is particularly useful in those design situations a measure of flexibility in the use of a board-mounted header that is designed to accept plug-in printed circuit board of different lengths, i.e., full-and half-length cards as well as those situations in which a connector terminated cable is mated with board-mounted header.

As will be apparent to those skilled in the art, various changes and modifications may be made to the illustrated pin mounted support for printed circuit cards and connectors of the present invention without departing from the spirit and scope of the invention as determined in the appended claims and their legal equivalent.

What is claimed is:

1. A pin mounted support system for mounting a printed circuit board to a header, comprising:

a header having an array of pins with a selected inter-pin spacing;

a printed circuit board having a connector along one edge thereof, said connector having an array of electrical contacts complementary to said pins for connection thereto;

at least one support body having at least two pin-receiving bores separated by the predetermined inter-pin spacing and mounted upon selected ones of said pins of said header, said support body having a groove formed therein in substantial alignment with the axes of the bores for accepting a lateral edge of said printed circuit board to align and guide said printed circuit board and its connector into its mated position with said header.

2. The pin mounted support system of claim 1, wherein said support body comprises:

a base having the pin-receiving bores formed therein and at least first and second spaced sidewalls extending from said base to define the groove.

3. The pin mounted support system of claim 2, wherein said support body further comprises:

an intermediate section between said base and said first and second sidewalls, said intermediate section defining a shoulder with said base.

4. The pin mounted support system of claim 2, wherein the pin-receiving bores of said base are arranged in a rectangular array.

5. A pin mounted support for mating a printed circuit board having a connector associated therewith to a header having an array of pins with a selected inter-pin spacing, comprising:

a body section having at least two pin-receiving bores separated by a predetermined inter-pin spacing and mountable upon selected ones of the pins of the header, said body section having a groove formed therein in substantial alignment with the axes of the bores for accepting a lateral edge of a printed circuit board to align and guide the printed circuit board and its connector into its mated position with the header.

6. The pin mounted support system of claim 5, wherein said body section comprises:

a base having the pin-receiving bores formed therein and at least first and second spaced sidewalls extending from said base to define the groove.

7. The pin mounted support system of claim 6, wherein said body section further comprises:

an intermediate section between said base section and said first and second sidewalls, said intermediate section defining a shoulder with said base.

8. The pin mounted support system of claim 6, wherein the pin-receiving bores of said base are arranged in a rectangular array.

9. A pin mounted support system for mounting a connector to a header, comprising:

a header having an array of pins with a selected inter-pin spacing;

a connector having an array of electrical contacts complementary to said pins for connection thereto;

at least one tab having at least two pin-receiving bores separated by the predetermined inter-pin spacing and mounted upon selected ones of the pins of said header to delimit the position on said header for receiving said connector.

10. The pin mounted support system of claim 9, wherein said tab is formed as a parallelepiped.

11. The pin mounted support system of claim 9, further comprising:

a hold-down strip connected to said header by fasteners for holding the connector in position in the header.

12. A pin mounted tab for use with an electrical header having an array of pins arranged in a selected pattern with a predetermined inter-pin spacing, comprising:

a body having at least two pin-receiving bores separated by said predetermined inter-pin spacing and mountable upon corresponding pins of an electrical header to delimit a mating connector position.

13. The pin mounted tab of claim 12, wherein said body is formed as a parallelepiped.

* * * * *